US009911316B2

(12) United States Patent
Lin et al.

(10) Patent No.: US 9,911,316 B2
(45) Date of Patent: Mar. 6, 2018

(54) ALARM DEVICE FOR FEEDTHROUGH ASSEMBLY AND ALARM METHOD THEREOF

(71) Applicant: APPLIED NANO TECHNOLOGY SCIENCE, INC., Hsinchu County (TW)

(72) Inventors: Hongchi Lin, Hsinchu County (TW); Minsu Hsiao, Hsinchu County (TW)

( * ) Notice: Subject to any disclaimer, the term of this patent is extended or adjusted under 35 U.S.C. 154(b) by 0 days.

(21) Appl. No.: 15/286,594

(22) Filed: Oct. 6, 2016

(65) Prior Publication Data

US 2017/0372595 A1 Dec. 28, 2017

(30) Foreign Application Priority Data

Jun. 23, 2016 (TW) ..... 105119768 A

(51) Int. Cl.
*G08B 21/00* (2006.01)
*G08B 29/02* (2006.01)
*G08B 21/18* (2006.01)

(52) U.S. Cl.
CPC ..... *G08B 29/02* (2013.01); *G08B 21/187* (2013.01)

(58) Field of Classification Search
CPC ..... G02B 6/4248; C23C 16/4401
USPC ..... 340/605
See application file for complete search history.

(56) References Cited

U.S. PATENT DOCUMENTS 4,565,093 A * 1/1986 Jurva ..... H01M 2/065 429/90
5,337,612 A * 8/1994 Evans ..... G01L 19/0046 73/706
6,526,212 B1 * 2/2003 Mishriky ..... G02B 6/4248 385/138
2002/0172446 A1 * 11/2002 Fernald ..... G01K 5/52 385/12
2007/0003206 A1 * 1/2007 Dunphy ..... E21B 47/123 385/138
2016/0326648 A1 * 11/2016 Lam ..... F16K 25/00

* cited by examiner

*Primary Examiner* — Fabricio R Murillo Garcia

(57) ABSTRACT

An alarm device for feedthrough assembly is proposed. The device comprises a body having a chamber, a sealing module configured on a first surface of the body for connecting to a feedthrough assembly, wherein a first surface has a hole across the chamber, and an alarm assembly configured in the chamber. In addition, if a shaft seal of the feedthrough assembly is failure, a pressure difference produced between the chamber and inner shaft seal forces the alarm assembly to move toward the feedthrough assembly.

7 Claims, 5 Drawing Sheets

100 alarm device
110 body
120 alarm assembly
130 sealing module 200 alarm device
210 body
214 chamber
216 second surface
220 alarm assembly
230 sealing module
232 sealing rings
240 fastener
250 cover plate
260 cover 300 alarm device
320 alarm assembly
900 feedthrough assembly 400 alarm device
414 chamber
420 alarm assembly
900 feedthrough assembly
910 ferrofluid shaft seal
920 ferrofluid shaft seal
930 inner space
940 center channel
950 drill-hole
960 Atmospheric end

ALARM DEVICE FOR FEEDTHROUGH ASSEMBLY AND ALARM METHOD THEREOF

BACKGROUND OF THE INVENTION

Technical Field

The present invention relates to an alarm device, and more particularly, to an alarm device for feedthrough assembly and alarm method thereof.

Description of Related Art

To allow the feedthrough assembly being operated safely and consistently under the required conditions, the feedthrough assembly requires shaft seal to prevent leakage of the lubricant within the assembly, and to prevent external dust, moisture, foreign substances, liquids, gases and other substances from entering into the feedthrough assembly. The assembly for such purpose is the feedthrough assembly.

Magnetic Fluid, made of magnetic particles, surfactants and base carrier liquid, is mostly used as the medium in shaft seal of feedthroughs. Magnetic particles, nano-ferromagnetic molecular covered by base carrier liquid, will form into different kinds of shapes distributed along with magnetic lines of flux when affected by externally magnetic field, which enables magnetic fluid to formulate an enclosed environment, such that the external magnetic field and inserted magnetic fluid will formulate a barrier between the tiny gap. Thus, the implementation of magnetic fluid seal separates the internal part into two compartments.

Some procedures requires vacuum environment. The inner body with installed shaft seal used with ferrofluid can form an enclosed space and then, by using the vacuum suction pump, it creates a vacuum. Normally, the ferrofluid can tolerate the pressure difference between inner vacuum and the external environment.

Magnetic fluid, or ferrofluid, used as the shaft seal in the feedthrough assembly, is featured for its tightness, no solid friction loss, no pollution produced from seal material abrasion powder, no high temperature and noise induced from contact friction. Moreover, it has longer life and easy for maintenance. Above all, ferrofluid shaft seal is best recommended for all kinds of accurate environmental sealing system.

As technology advances, the shaft seal used with ferrofluid requires higher quality which can meet the sealing standard under strict conditions and also maintain sealing with the shaft in relative movement. All kinds of feedthrough assembly become consequential.

Feedthrough assembly with ferrofluid shaft seal can be applied in different tough working environments, though, it has limitations. For example, the carrier liquid of magnetic fluid will easily evaporate because of high steam pressure, which leads to life shortening or weakening of operation under extreme conditions of the sealing device. Other than that, higher working temperature accelerates the evaporation of the carrier liquid or demagnetization or decreased strength of the magnets, which means reducing the tightness of the sealing. Generally, the proper temperature of working environment should be less than 80 degrees Celsius for magnetic fluid seal device.

Many reasons are known to affect the efficacy of ferrofluid shaft seal, such as overheat of the shaft seal, solid deposition obstruction, high activity gas invasion or degradation failure of the device, etc. The failure of shaft seal will cause abnormalities, and thus, it is necessary to arrange regular test for the shaft seal, in case of crisis which leads to much more losses. Conventionally, the position of malfunction can be detected through the Helium leak detector, which spends a lot of time to check each shat seal of failure among the whole body. If the shaft seal is finally detected after all failure, it is usually too late to change machine. Generally, time consumption of conventional detection is large and it causes great losses.

SUMMARY OF THE INVENTION

In summary, it still lacks an alarm device or an alarm method to warn that the feedthrough assembly is disabled. Therefore, the purpose of this invention is to provide an early warning for the malfunction of feedthrough assembly. In this invention, an alarm assembly is proposed to sense a pressure difference caused by a failure of feedthrough assembly. Based on this alarm device, the failure of feedthrough assembly can be warned in time. Moreover, it costs not much time to test the shaft seal or process troubleshooting which leads to critical losses.

In a first aspect of the invention, an alarm device for feedthrough assembly is proposed. The device comprises a body having a chamber, a sealing module configured on a first surface of the body for connecting to a feedthrough assembly, wherein a first surface has a hole across the chamber, and an alarm assembly configured in the chamber. In addition, if a shaft seal of the feedthrough assembly has failed, a pressure difference produced between the chamber and inner shaft seal forces the alarm assembly to move toward the feedthrough assembly.

In a second aspect of the invention, an alarm method for feedthrough assembly is proposed. The method comprises first connecting to a feedthrough assembly via a sealing module of an alarm device, then connecting to a chamber of said alarm device by a drill-hole of said feedthrough assembly, producing a pressure between said chamber and a shaft seal inside when said feedthrough assembly is failure, and forcing an alarm assembly moving to said feed through for warning.

According to one aspect, sealing module comprises a plurality of sealing rings for sealing the feedthrough assembly.

According to one aspect, sealing module comprises a screw thread for connecting the feedthrough assembly.

According to one aspect, a drill-hole of said feedthrough assembly connects to the chamber of the alarm device for use with the alarm assembly to sense the pressure difference.

According to one aspect, alarm assembly moving to said feedthrough assembly is observed to early warn a failure feedthrough assembly.

According to one aspect, the alarm device comprises a cover to cover the body.

According to one aspect, the alarm device comprises a fastener to prevent the alarm assembly from departing the chamber.

According to one aspect, a diameter of axle of the feedthrough assembly is between ø12 mm and ø100 mm.

According to one aspect, the alarm device comprises a surface coating on the alarm assembly to increase a sensitivity of the alarm assembly.

According to one aspect, the surface coating has a range of friction coefficient between 0.1-3.

A detailed description is given in the following embodiments with reference to the accompanying drawings.

BRIEF DESCRIPTION OF THE DRAWINGS

The components, characteristics and advantages of the present invention may be understood by the detailed descriptions of the preferred embodiments outlined in the specification and the drawings attached. Embodiments of the invention are illustrated by way of example, and not by way of limitation, in the figures of the accompanying drawings in which like reference numerals refer to similar elements.

DETAILED DESCRIPTION OF THE INVENTION

Some preferred embodiments of the present invention will now be described in greater detail. However, it should be recognized that the preferred embodiments of the present invention are provided for illustration rather than limiting the present invention. In addition, the present invention can be practiced in a wide range of other embodiments besides those explicitly described, and the scope of the present invention is not expressly limited except as specified in the accompanying claims.

Figure 1:
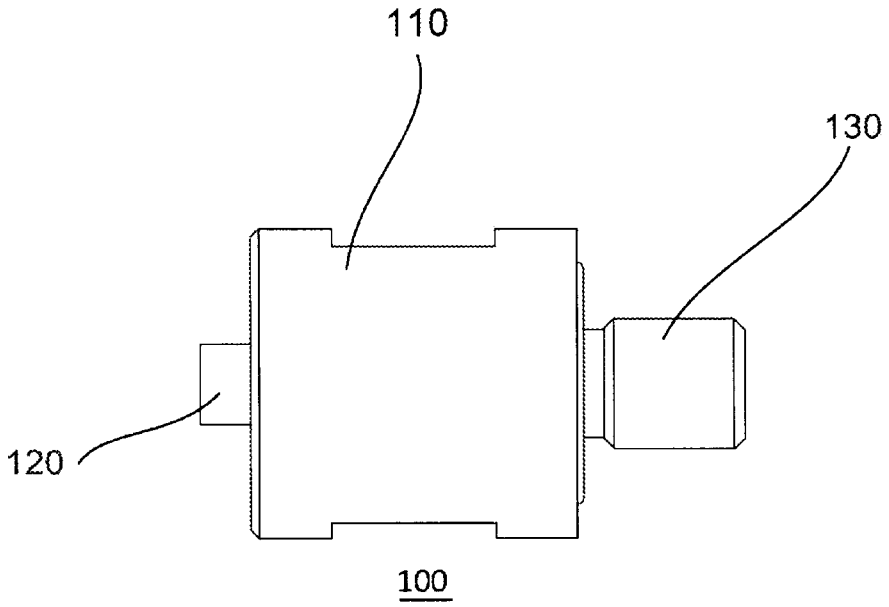
FIG. 1 shows an example of an alarm device for feedthrough assembly according to an embodiment of the invention.

The present invention is applied to feedthrough assembly with ferrofluid shaft seal, but not limited. The alarm device can also be applied to other feedthrough assembly with a pressure difference between inner and outer shaft seal. FIG. 1 shows an example of an alarm device for feedthrough assembly according to an embodiment of the invention. To warn the failure of feedthrough assembly, an alarm device 100 is proposed. The alarm device 100 at least comprises a body 110, a sealing module 130 and an alarm assembly 120. The alarm device in conjunction with a feedthrough assembly warns users that the feedthrough assembly is about to lose effects based on the movement of alarm assembly 120 in case of a pressure difference produced between inner and outer shaft seal.

Figure 2A:
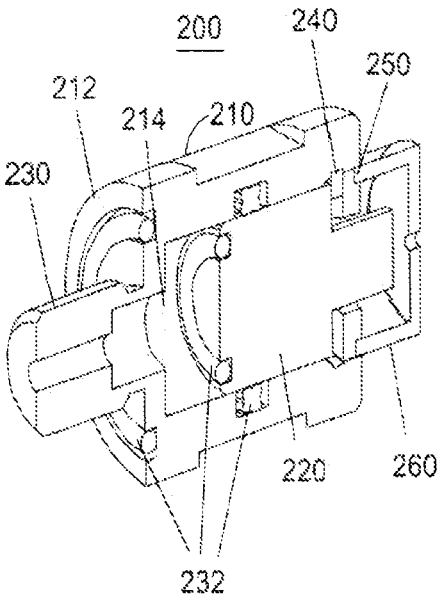
FIG. 2A shows an example of an alarm device with operational feedthrough assembly according to an embodiment of the invention.

FIG. 2A shows an example of an alarm device 200 with operational feedthrough assembly according to an embodiment of the invention. In the embodiment, the alarm device 200 comprises a body 210 having a chamber 214, a sealing module 230 configured on a first surface 212 of the body 210 for connecting to a feedthrough assembly, wherein a first surface 212 is the surface of alarm device in conjunction with the feedthrough assembly. The first surface has a hole across the chamber 214. Moreover, the alarm device 200 further comprises an alarm assembly 220 configured in the chamber 214.

Referring to FIG. 2A, in one embodiment, sealing module 230 comprises a plurality of sealing rings 232 for sealing the alarm device 200 and the feedthrough assembly. The sealing rings 232 can be installed in the bottom side of the alarm assembly 220 or the side groove of the alarm assembly 220. It should be noted that the sealing rings 232 can be an O-ring, X-ring or other kinds of rings which can appropriately match the feedthrough assembly. In one embodiment, sealing module 230 connects the feedthrough assembly having a diameter between ø12 mm to ø100 mm. Not the sealing rings 232, but also other sealing materials can be settled on the body 210 or on the alarm assembly 220 by gouging grooves. The sealing material or sealing method can be easily made by a person ordinarily skilled in the art.

Referring to FIG. 2A, in one embodiment, sealing module 230 has a screw thread to connect to the feedthrough assembly and lock the feedthrough assembly. Both the crew thread and sealing rings of sealing module 230 are used to make sure that alarm device 200 and feedthrough assembly are effectively sealed so that the chamber 214 in conjunction with the feedthrough assembly is constructed as a connecting space of chamber 214 and feedthrough assembly.

Referring to FIG. 2A, in one embodiment, alarm device 200 can comprise a fastener 240 configured on the alarm assembly 220 to prevent the alarm assembly 220 from departing the chamber 214. In one embodiment, alarm device 200 can comprise a cover plate 250 on the fastener 240 to avoid the fastener 240 and the alarm assembly 220 departing from the alarm device 200. Furthermore, the cover plate can be used to avoid dismantling by non-users' mistake.

Figure 2B:
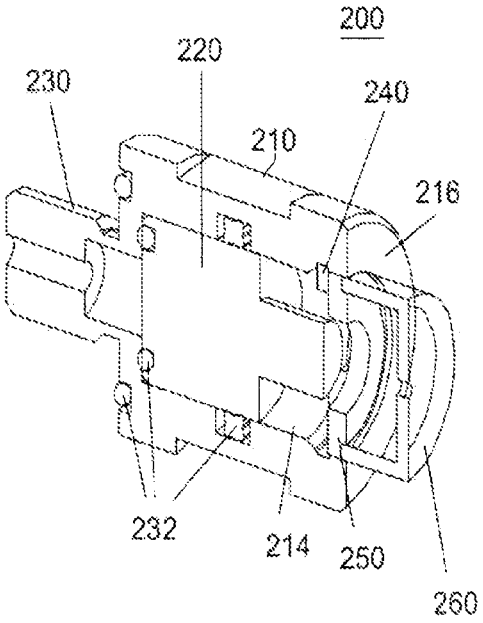
FIG. 2B shows an example of an alarm device with disabled feedthrough assembly according to an embodiment of the invention.

Referring to FIGS. 2A and 2B, in one embodiment, alarm device 200 can comprises a cover 260, made of acrylic, covered on a second surface 216 of the body 210. The cover 260 protects the alarm assembly 220 from inevitably touching from external condition, such as users' mistake or external force, providing an undisturbed environment for detection. The second surface 216 is the surface opposite to the first surface 212 of the alarm device 200, and the alarm assembly 220 is embedded or can be moved in the second surface 216 so that a user can easily observe the movement of the alarm assembly 220.

FIG. 2B shows an example of an alarm device with disabled feedthrough assembly according to an embodiment of the invention. In the embodiment, the alarm device 200 comprises a body 210 having a chamber 214, a sealing module 230 configured on a first surface 212 of the body 210 for connecting to a feedthrough assembly, wherein a first surface 212 is the surface of alarm device in conjunction with the feedthrough assembly. The first surface has a hole across the chamber 214. Moreover, the alarm device 200 further comprises an alarm assembly 220 configured in the chamber 214.

Referring to FIG. 2B, in one embodiment, sealing module 230 comprises a plurality of sealing rings 232 for sealing the alarm device 200 and the feedthrough assembly. The sealing rings 232 can be installed in the bottom side of the alarm assembly 220 or the side groove of the alarm assembly 220. It should be noted that the sealing rings 232 can be an O-ring, X-ring or other kinds of rings which can appropriately match the feedthrough assembly. In one embodiment, sealing module 230 connects the feedthrough assembly having a diameter between ø12 mm to ø100 mm. Not the sealing rings 232, but also other sealing materials can be settled on the body 210 or on the alarm assembly 220 by gouging grooves. The sealing material or sealing method can be easily made by a person ordinarily skilled in the art.

Referring to FIG. 2B, in one embodiment, sealing module 230 has a screw thread to connect to the feedthrough assembly and lock the feedthrough assembly. Both the crew thread and sealing rings of sealing module 230 are used to make sure that alarm device 200 and feedthrough assembly are effectively sealed so that the chamber 214 in conjunction with the feedthrough assembly is constructed as a connecting space of chamber 214 and feedthrough assembly.

Referring to FIG. 2B, in one embodiment, alarm device 200 can comprise a fastener 240 configured on the alarm assembly 220 to prevent the alarm assembly 220 from departing the chamber 214. In one embodiment, alarm device 200 can comprise a cover plate 250 on the fastener 240 to avoid the fastener 240 and the alarm assembly 220 departing from the alarm device 200. Furthermore, the cover plate can be used to avoid dismantling by non-user's mistake.

Referring to FIGS. 2A and 2B, in one embodiment, alarm device 200 can comprises a cover 260, made of acrylic, covered on a second surface 216 of the body 210. The cover 260 protects the alarm assembly 220 from inevitable touching from external condition, such as user's mistake or external force, providing an undisturbed environment for detection. The second surface 216 is the surface opposite to the first surface 212 of the alarm device 200, and the alarm assembly 220 is embedded or moving in the second surface 216 so that a user can easily observe the movement of the alarm assembly 220.

Referring to FIGS. 2A and 2B, in one embodiment, in the FIG. 2A, if the feedthrough assembly in conjunction with the alarm device 200 operates normally, the location of alarm assembly 220 is close to the second surface 216. In other words, a user may easily observe the movement of alarm assembly 220 connected to the fastener 240 outside the cover 260. In the FIG. 2B, the location of alarm assembly 220 is close to the first surface 216 because a pressure difference forces the alarm assembly 240 to move toward the chamber 214. In this situation, the user may not find the alarm assembly 240 outside the cover, and can be warned that the shaft seal of the feedthrough assembly is about to lose its effects.

Referring to FIGS. 2A and 2B, in one embodiment, the alarm assembly further comprises a surface coating (not shown in figures) on the surface of alarm assembly 220 to increase sensitivity. The surface coating made of special materials makes the surface of alarm assembly 220 smooth such that the failure of feedthrough assembly can be sensed quickly. The friction coefficient of alarm assembly's surface is highly related to the sensitivity of alarm assembly 220 because alarm assembly's moving touch the sealing rings at every moment 232. In present invention, various materials to lower sensitivity of alarm assembly 220 can be applied. In one embodiment, the range of friction coefficient is between 0.1-3.

Figure 3:
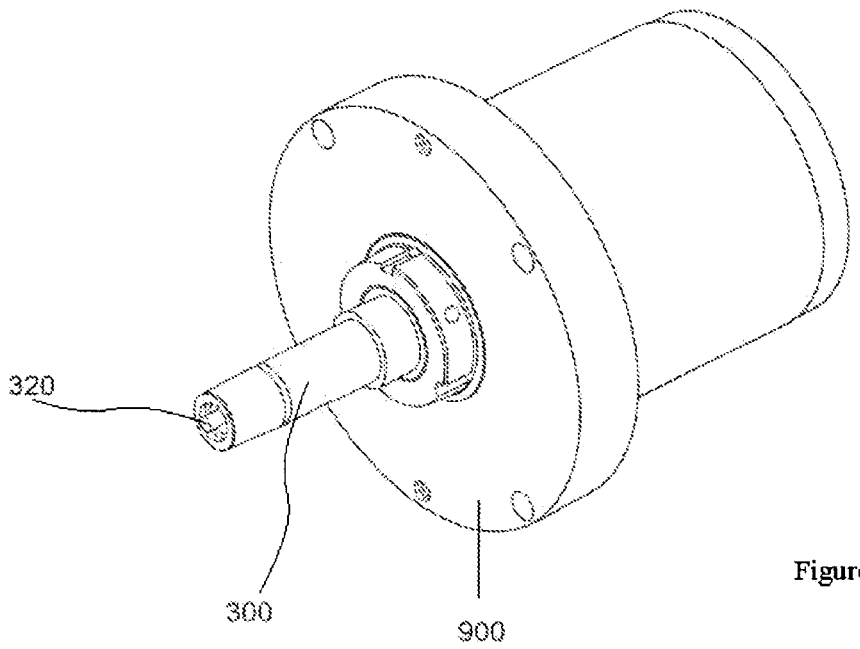
FIG. 3 shows an example of an alarm device connected to a feedthrough assembly according to an embodiment of the invention.

Alternatively, in one embodiment, Teflon (Polytetrafluoroethene) can be the material of surface coating. The surface of alarm assembly 220 has a lower friction coefficient, for example, around 0.1, by coating with Teflon. In other embodiment, instead of using Teflon as alarm assembly 220, which has a high coefficient of thermal expansion, coating with Teflon only the surface is an advantage to avoid alarm assembly 220 sharply influenced by thermal expansion FIG. 3 shows an example of an alarm device connected to a feedthrough assembly according to an embodiment of the invention. Referring to FIG. 3, alarm device 300 is configured on the top of feedthrough assembly 900. The alarm device 300 and feedthrough assembly 900 are closely connected that a user may find the location of alarm assembly 320 to determine whether the feedthrough assembly has failed or not.

Figure 4:
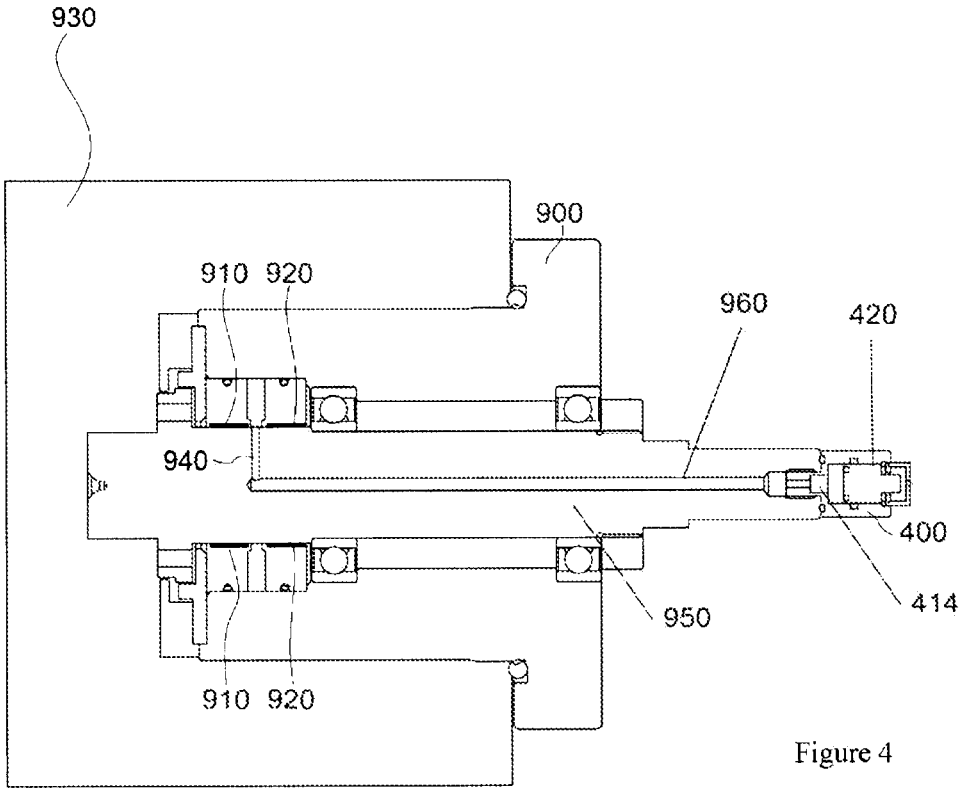
FIG. 4 shows an example of an alarm device and feedthrough assembly according to an embodiment of the invention.

FIG. 4 shows an example of an alarm device and feedthrough assembly according to an embodiment of the invention. Referring to FIG. 4, feedthrough assembly 900 comprises two ferrofluid shaft seals 910, 920, drill-hole 950, and a center channel 940 (usually with a 2 nm hole.) Via the ferrofluid shaft seals 910, 920, an inner space 930 is formed as an isolated space. In one embodiment, the ferrofluid shaft seals 910, 920 of the feedthrough assembly 900 have well tolerance of the pressure difference between two spaces, for example, inner vacuum and atmospheric environment.

Referring to FIG. 4, in one embodiment, when front ferrofluid shaft seal 910 is fail and only rear ferrofluid shaft seal 910 works normally, the air in outer space which is between two ferrofluid shaft seals and alarm device 400 will be instantly inhaled into inner vacuum to balance the pressure difference between outside and inside environments. At the same time, for sensing the pressure difference, the alarm assembly 420 is pulled toward the feedthrough assembly 900 by the air. Therefore, a user can be warned that the shaft seal in the feedthrough assembly is going to fail or about to lose its effects by observing the movement of alarm assembly. As the result, the user may have enough time to find the trouble or to change the feedthrough assembly, lowering losses in product process.

Figure 5:
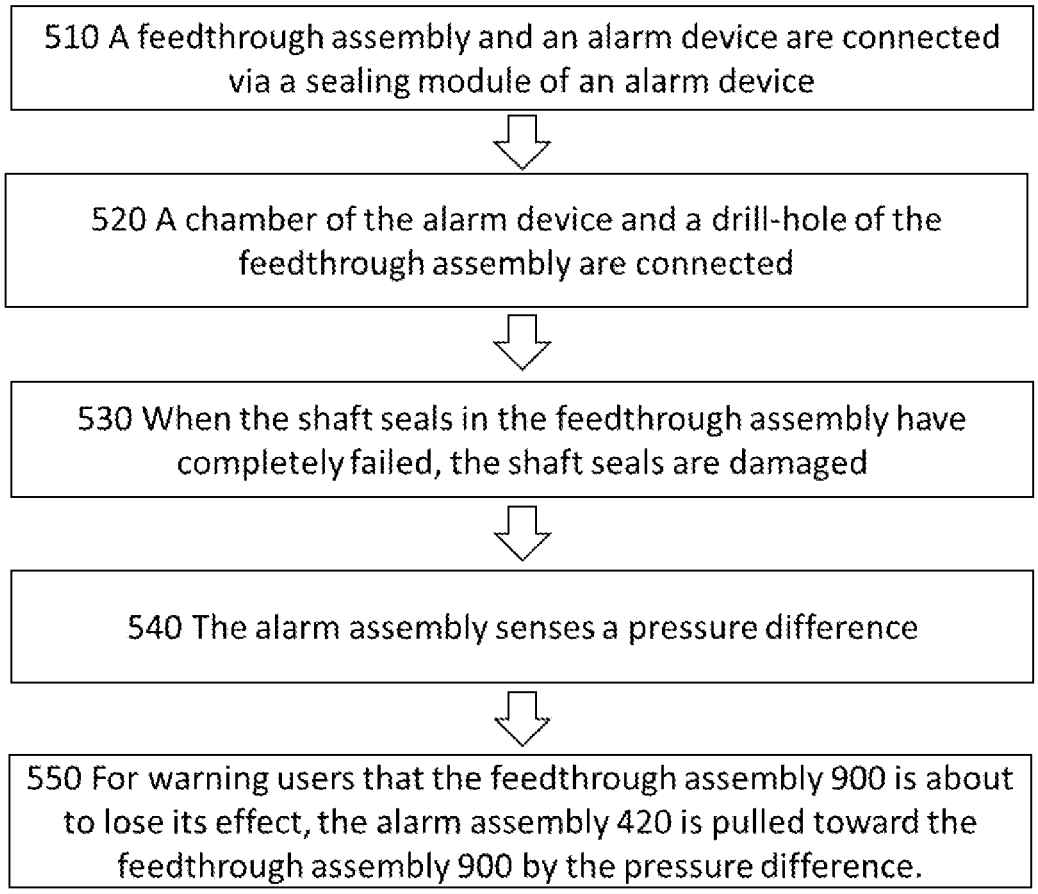
FIG. 5 shows an alarm method for feedthrough assembly according to an embodiment of the invention.

To achieve early warning for the failure of feedthrough assembly, an alarm device 500 is proposed. FIG. 5 shows an alarm method 500 for feedthrough assembly according to an embodiment of the invention. Referring to FIG. 5, accompanying with FIG. 1-4 and alarm device 100, steps of method 500 are illustrated as follows.

As shown in step 510, referring to FIG. 5, a feedthrough assembly and an alarm device are closely connected via a sealing module of an alarm device. In the step 510, sealing module 230 comprises a plurality of sealing rings 232 for sealing the alarm device 200 and the feedthrough assembly. The sealing rings 232 can be installed in the bottom side of the alarm assembly 220 or the side groove of the alarm assembly 220. It should be noted that the sealing rings 232 can be an O-ring, X-ring or other kind rings which can appropriately match the feedthrough assembly. In one embodiment, sealing module 230 connects the feedthrough assembly having a diameter between ø12 mm to ø100 mm.

As shown in step 510, referring to FIG. 5, in one embodiment, sealing module 230 has a screw thread to connect to the feedthrough assembly and lock the feedthrough assembly. Both the crew thread and sealing rings of sealing module 230 are used to make sure that alarm device 200 and feedthrough assembly are effectively sealed so that the chamber 214 in conjunction with the feedthrough assembly is constructed as a connecting space of chamber 214 and feedthrough assembly.

As shown in step 510, referring to FIG. 5, in one embodiment, alarm device 200 can comprise a fastener 240 configured on the alarm assembly 220 to prevent the alarm assembly 220 from departing the chamber 214. In one embodiment, alarm device 200 can comprise a cover plate 250 on the fastener 240 to avoid the fastener 240 and the alarm assembly 220 departing from the alarm device 200. Furthermore, the cover plate can be used to avoid dismantling by non-users' mistake.

As shown in step 510, referring to FIG. 5, in one embodiment, alarm device 200 can comprises a cover 260, made of acrylic, covered on a second surface 216 of the body 210. The cover 260 protects the alarm assembly 220 from being inevitably touched under unstable conditions, such as users' mistake or external force, providing an undisturbed environment for detection. The second surface 216 is the surface opposite to the first surface 212 of the alarm device 200, and the alarm assembly 220 is embedded or moving in the second surface 216 so that a user can easily observe the movement of the alarm assembly 220.

As shown in step 520, referring to FIG. 5, a chamber of the alarm device and a drill-hole of the feedthrough assembly are connected. In step 520, when a process of products requires a vacuum environment, ferrofluid shaft seals 910, 920, can be configured to form a closed space, and then the inner shaft seals become a vacuum space using air extracting pump. On the other hand, after the feedthrough assembly 900 and alarm device 400 are connected, the ferrofluid shaft seals 910, 920 of feedthrough assembly 900, drill-hole 950 and the chamber 214 form another closed space having an atmospheric pressure. These two spaces, which are vacuum and one atmosphere, are isolated via the ferrofluid shaft seals 910, 920 having a capacity to resist pressure differences.

Referring to FIG. 5, in the step 530, when the shaft seals in the feedthrough assembly have completely failed, the shaft seals are damaged. In one embodiment, overheat of the shaft seals, solid deposition obstruction, high activity gas invasion or degradation failure of the device may cause one of shift seals malfunctioning. In step 540, in one embodiment, before the shaft seals in the feedthrough assembly have not completely failed, for example, a failure of ferrofluid shaft seal 910 and an effective ferrofluid shaft seal 920, an air will be inhaled into inner space such that the alarm assembly will sense a pressure difference. In step 550, in one embodiment, for warning users that the feedthrough assembly 900 is about to lose its effect, the alarm assembly 420 is pulled toward the feedthrough assembly 900 by the pressure difference.

Referring to FIG. 1 and FIG. 4, in one embodiment, the alarm device 100 of the present invention is able to maintain a good warning effect in the following conditions: 1−10*E−7 torr for the detecting range, 0~80° C. for the temperature range, ø12 mm-ϕ527 mm for shaft diameter, and applied to active gas or inactive gas.

The main contributions of this invention are summarized as follows:

(a) The present invention proposes an alarm device and an alarm method for feedthrough assembly to warn users the forthcoming failure of the feedthrough assembly.

(b) Compared with conventional Helium leak detector, the present invention saves a lot of time and provides a much easier and safer method for setting device.

(c) The present invention shows a brilliant performance to give a warning before a feedthrough assembly have not completely failed.

Many of the methods are described in their most basic form, but processes can be added to or deleted from any of the methods and information can be added or subtracted from any of the described messages without departing from the basic scope of the present invention. It will be apparent to those skilled in the art that many further modifications and adaptations can be made. The particular embodiments are not provided to limit the invention but to illustrate it. The scope of the embodiments of the present invention is not determined by the specific examples provided above but only by the claims below.

If it is said that an element "A" is coupled to or with element "B," element A may be directly coupled to element B or be indirectly coupled through, for example, element C. When the specification or claims state that a component, feature, structure, process, or characteristic A "causes" a component, feature, structure, process, or characteristic B, it means that "A" is at least a partial cause of "B" but that there may also be at least one other component, feature, structure, process, or characteristic that assists in causing "B." If the specification indicates that a component, feature, structure, process, or characteristic "may", "might", or "could" be included, that particular component, feature, structure, process, or characteristic is not required to be included. If the specification or claim refers to "a" or "an" element, this does not mean that there is only one of the described elements.

An embodiment is an implementation or example of the present invention. Reference in the specification to "an embodiment," "one embodiment," "some embodiments," or "other embodiments" means that a particular feature, structure, or characteristic described in connection with the embodiments is included in at least some embodiments, but not necessarily all embodiments. The various appearances of "an embodiment," "one embodiment," or "some embodiments" are not necessarily all referred to the same embodiments. It should be appreciated that in the foregoing description of exemplary embodiments of the present invention, various features are sometimes grouped together in a single embodiment, figure, or description thereof for the purpose of streamlining the disclosure and aiding in the understanding of one or more of the various inventive aspects. This method of disclosure, however, is not to be interpreted as reflecting an intention that the claimed invention requires more features than are expressly recited in each claim. Rather, as the following claims reflect, inventive aspects lie in less than all features of a single foregoing disclosed embodiment. Thus, the claims are hereby expressly incorporated into this description, with each claim standing on its own as a separate embodiment of this invention.

As will be understood by persons skilled in the art, the foregoing preferred embodiment of the present invention illustrates the present invention rather than limit the present invention. Having described the invention in connection with a preferred embodiment, modifications will be suggested to those skilled in the art. Thus, the invention is not to be limited to this embodiment, but rather the invention is intended to cover various modifications and similar arrangements included within the spirit and scope of the appended claims, the scope of which should be accorded the broadest interpretation, thereby encompassing all such modifications and similar structures. While the preferred embodiment of the invention has been illustrated and described, it will be appreciated that various changes can be made without departing from the spirit and scope of the invention.

What is claimed is:

1. An alarm device for feedthrough assembly comprising:

a body having a chamber;

a sealing module configured on a first surface of said body for connecting to a feedthrough assembly, wherein a first surface has a hole across said chamber; wherein said sealing module comprises a plurality of sealing rings for sealing said feedthrough assembly;

an alarm assembly configured in said chamber, wherein if a shaft seal of said feedthrough assembly is going to fail, a pressure difference produced between said chamber and an inner shaft seal forces said alarm assembly to move toward said feedthrough assembly;

wherein a drill-hole of said feedthrough assembly connects to said chamber of alarm device for use with said alarm assembly to sense said pressure difference; and a surface coating on said alarm assembly to increase a sensitivity of said alarm assembly, wherein said surface coating has a range of friction coefficient between 0.1-3.

2. The device of claim 1, wherein said sealing module comprises a screw thread for connecting said feedthrough assembly.

3. The device of claim 1, wherein said alarm assembly moving to said feedthrough assembly is observed to early warn a failure feedthrough assembly.

4. The device of claim 1, further comprising a cover to cover said body.

5. The device of claim 1, further comprising a fastener to prevent said alarm assembly from departing said chamber.

6. The device of claim 1, wherein a diameter of axle of said feedthrough assembly is between ø12 mm and ø100 mm.

7. An alarm method for a feedthrough assembly comprising:

connecting an alarm device to the feedthrough assembly via a sealing module of the alarm device;

sealing said feedthrough assembly with a plurality of sealing rings comprised in said sealing module;

connecting a chamber of said alarm device to a drill-hole of said feedthrough assembly;

producing a pressure difference between said chamber and an inner shaft seal when said feedthrough assembly failed;

sensing said produced pressure difference by using said alarm device with the connection of said chamber to the said drill-hole;

increasing a sensitivity of said alarm device with a surface coating on said alarm device; wherein said surface coating has a range of friction coefficient between 0.1-3 and forcing the alarm device to move toward said feedthrough assembly for warning when said feedthrough assembly failed.

* * * * *